US005132585A

United States Patent [19]

Kane et al.

[11] Patent Number: 5,132,585

[45] Date of Patent: Jul. 21, 1992

[54] PROJECTION DISPLAY FACEPLATE EMPLOYING AN OPTICALLY TRANSMISSIVE DIAMOND COATING OF HIGH THERMAL CONDUCTIVITY

[75] Inventors: Robert C. Kane, Woodstock; Norman W. Parker, Wheaton, both of Ill.; James E. Jaskie, Scottsdale, Ariz.

[73] Assignee: Motorola, Inc., Schaumburg, Ill.

[21] Appl. No.: 632,255

[22] Filed: Dec. 21, 1990

[51] Int. Cl.[5] ..... H01J 7/24

[52] U.S. Cl. ..... 313/44; 313/45; 313/46; 313/479

[58] Field of Search ..... 313/44, 46, 479, 477 R, 313/478, 45; 427/64, 68

[56] References Cited

U.S. PATENT DOCUMENTS

| | | | |
|---|---|---|---|
| 3,426,230 | 2/1969 | Webb | 313/44 |
| 3,531,674 | 9/1970 | Spencer | 313/44 |
| 3,573,955 | 4/1971 | Gier et al. | 427/68 X |
| 3,672,931 | 6/1972 | Grosso et al. | 427/68 |
| 4,484,100 | 11/1984 | Sato | 313/44 |

*Primary Examiner*—Donald J. Yusko
*Assistant Examiner*—Ashok Patel
*Attorney, Agent, or Firm*—Wayne J. Egan; Eugene A. Parsons

[57] ABSTRACT

A display device exhibiting improved thermal performance at the faceplate by utilizing a layer of thermally highly conductive substantially optically transmissive solid material is provided. According to the invention, an optically transmissive display faceplate is disclosed having a substantially planar optically transmissive base sheet or a substantially optically transmissive region of substantially uniform thickness of a cathode ray tube envelope. On the base sheet is disposed at least one layer of substantially optically transmissive solid material, such as a deposited diamond film, with thermal conductivity greater than that of the faceplate material disposed on at least a part of a major surface of the substantially optically transmissive base sheet or substantially optically transmissive region of substantially uniform thickness of a cathode ray tube envelope. The base sheet also includes at least a layer of cathodoluminescent material, which cathodoluminescent material may be preferentially disposed on at least a part of a second major surface of the faceplate or, alternatively, on at least a part of the at least one layer of substantially optically transmissive solid material.

2 Claims, 4 Drawing Sheets

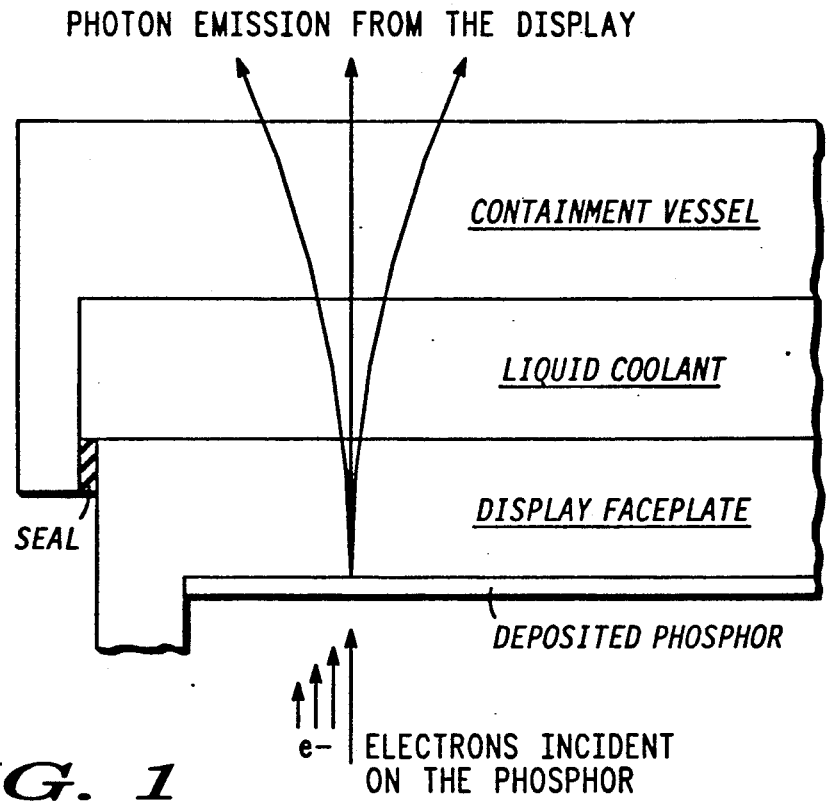
FIG. 1
-PRIOR ART-
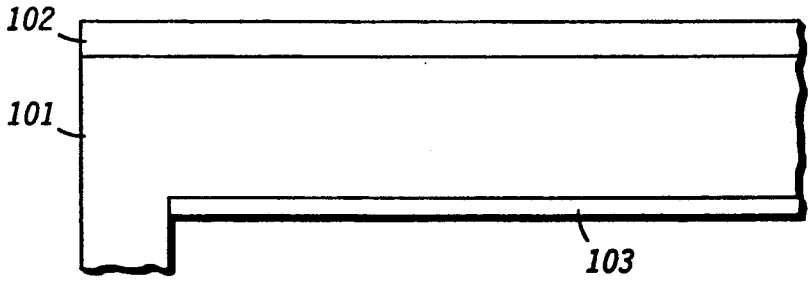
FIG. 2A
FIG. 2B
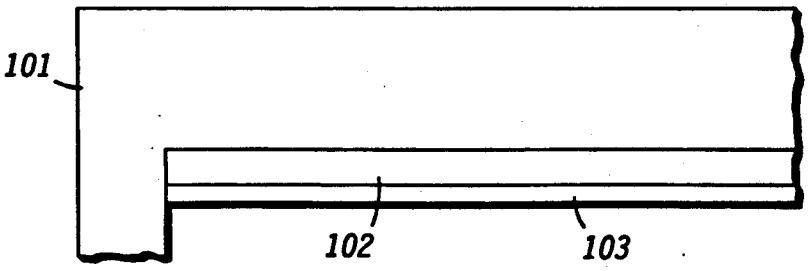

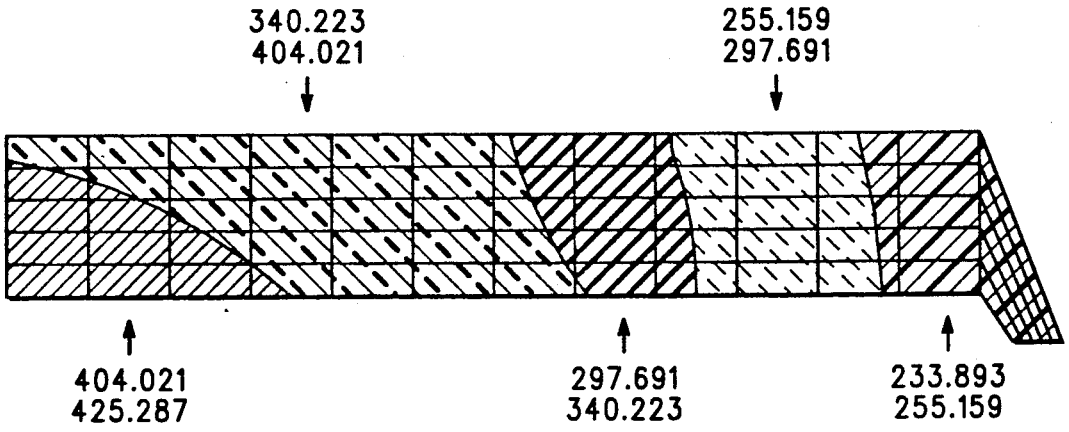
FIG. 3
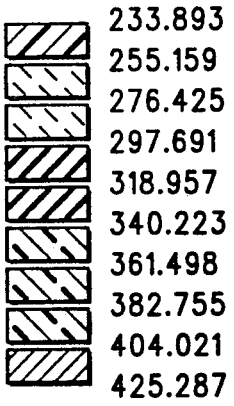

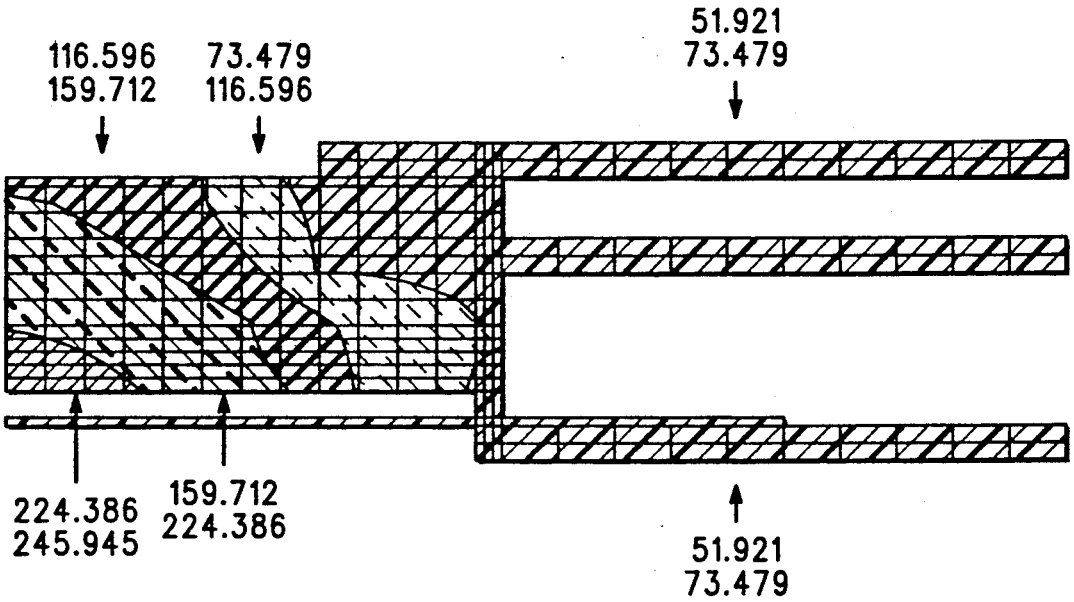
FIG. 4
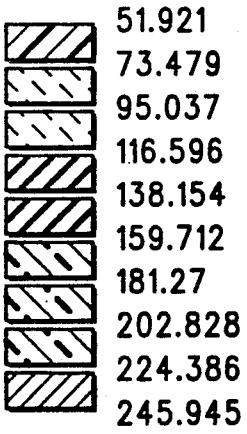

PROJECTION DISPLAY FACEPLATE EMPLOYING AN OPTICALLY TRANSMISSIVE DIAMOND COATING OF HIGH THERMAL CONDUCTIVITY

TECHNICAL FIELD

This invention relates generally to cathodoluminescent display devices and more particularly to cathodoluminescent display devices employing thermally conductive solid materials as a cooling mechanism and methods for realizing such devices.

BACKGROUND OF THE INVENTION

Cathodoluminescent image displays are known in the art. In these displays high energy electrons are directed at a cathodoluminescent material (phosphor) wherein some of the energy of the electrons is converted to photon energy some of which is emitted from the display. The energy conversion process is inefficient resulting in 80% or more of the energy of the impinging electrons being converted to heat energy in the phosphor.

The brightness, or luminous output, of a display is, in addition to other parameters, generally proportional to the density of electrons incident at the phosphor. That is, luminous output increases as current density increases. Many display applications require high brightness which correspondingly demands increased current density to the phosphor. The required high current density will also result in high heat energy density in the phosphor and immediate material on which the phosphor resides. Since the phosphor and faceplate materials are effective insulators they serve as relatively poor conductors of thermal energy. Unacceptably high temperatures may result which can severely degrade device performance due to thermal quenching of the phosphor material or physical damage to the device structure caused by stress induced failure. Further, since displays typically, are not uniformly illuminated, local hot spots due to high brightness local regions of illumination, may result.

One method of the prior art to reduce the temperature at the phosphor and photon emission region of the cathodoluminescent display is through the use of cooling fans to rapidly remove heat from the display. Cooling fans are unsuitable in some applications due to size, power, noise, and cooling capacity constraints.

A second method of the prior art to reduce the temperature at the phosphor and photon emission region of the cathodoluminescent display is through the use of convection cooling techniques and is depicted in FIG. 1. In this method a volume of liquid is disposed in contact with the display at the area of high thermal energy flux. Convection flow is utilized to carry the unwanted heat away from the display structure. The liquid medium must be held in a containment vessel and the containment vessel must be sealed and rigidly held in position with respect to the display surface. This cooling method may introduce unacceptable distortions to the image, which must traverse the extent of the cooling medium, because of the motion of the medium.

Therefore, a need exists to provide a method and/or a display apparatus to overcome at least some of these shortcomings of the prior art.

SUMMARY OF THE INVENTION

Pursuant to the invention disclosed herein at least some of these shortcomings, and others, are overcome. An optically transmissive display faceplate is disclosed wherein the faceplate may be a substantially planar optically transmissive base sheet or a substantially optically transmissive region of substantially uniform thickness of a cathode ray tube envelope on which resides at least one layer of substantially optically transmissive solid material, such as a deposited diamond film, with thermal conductivity greater than that of the faceplate material disposed on at least a part of a major surface of the substantially optically transmissive base sheet or substantially optically transmissive region of substantially uniform thickness of a cathode ray tube envelope, and also including at least a layer of cathodoluminescent material, which cathodoluminescent material may be preferentially disposed on at least a part of a second major surface of the faceplate or, alternatively, on at least a part of the at least one layer of substantially optically transmissive solid material.

BRIEF DESCRIPTION OF THE FIGURES

FIG. 1 is a partial side elevational cross-sectional view of a prior art display device employing a liquid convection cooling medium.

FIG. 2A is a partial side elevational cross-sectional view of a first embodiment of the invention.

FIG. 2B is a partial side elevational cross-sectional view of a second embodiment of the invention.

FIG. 3 is a thermal profile depiction of a quartz faceplate with no cooling mechanism.

FIG. 4 is a thermal profile depiction of a quartz faceplate employing convection cooling techniques of the prior art.

PREFERRED MODES FOR CARRYING OUT THE INVENTION

Figure 5:
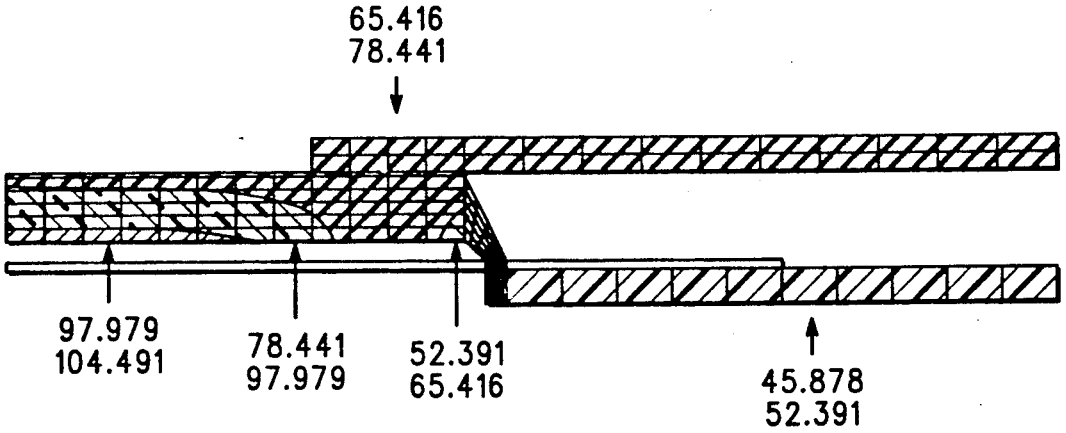
FIG. 5 is a thermal profile depiction of a quartz faceplate employing the methods of the present invention.
Figure 5:
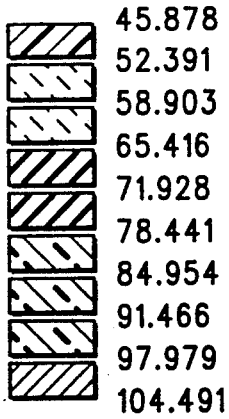

Referring now to FIG. 2A a partial side elevational cross-sectional depiction of a first embodiment of the invention is shown wherein a faceplate is comprised of a base sheet (101) having deposited on a first major surface a cathodoluminescent material (103) which cathodoluminescent material (103) will emit photons corresponding to energy associated with a preferred portion of the electromagnetic spectrum when energized by incident high energy electrons. A layer of substantially optically transmissive solid material (102), such as a diamond film, is deposited on at least a part of a second major surface of the base sheet (101). The substantially optically transmissive solid material (102) exhibits thermal characteristics, such as thermal conductivity, which are an improvement over the thermal characteristics of the base sheet (101) and cathodoluminescent material (103).

By disposing the substantially optically transmissive solid material (102) directly onto a surface of the base sheet (101), at least a portion of the thermal energy which has been imparted to the base sheet (101) and the cathodoluminescent material (103) as a result of the inefficient electron-to-photon conversion process will be conducted to the substantially optically transmissive solid material (102) and further conducted to a suitable dissipative element such as, for example, a radiating fin.

The faceplate may be a portion of an envelope of a cathode ray tube which portion exhibits a substantially optically transmissive characteristic and further exhibiting substantially uniform thickness.

The substantially optically transmissive solid material (102) may be deposited by any of many known methods such as, for example, thermally induced precipitative surface crystallization.

Referring now to FIG. 2B a partial side elevational cross-sectional view of a second embodiment of the invention is shown wherein a faceplate as described above with reference to FIG. 2A is provided. A layer of substantially optically transmissive solid material (102), such as a diamond film, is deposited on at least a part of a major surface of the base sheet (101). Subsequently, a layer of cathodoluminescent material (103) is deposited on at least a part of the layer of substantially optically transmissive solid material (102), which cathodoluminescent material (103) will emit photons corresponding to energy associated with a preferred portion of the electromagnetic spectrum when energized by incident high energy electrons. The substantially optically transmissive solid material (102) exhibits thermal characteristics, such as thermal conductivity, which are an improvement over the thermal characteristics of the base sheet (101) and cathodoluminescent material (103).

By disposing the substantially optically transmissive solid material (102) directly onto a surface of the base sheet (101), at least a portion of the thermal energy which has been imparted to the base sheet (101) and the cathodoluminescent material (103) as a result of the inefficient electron-to-photon conversion process will be conducted to the substantially optically transmissive solid material (102) and further conducted to a suitable dissipative element such as, for example, a radiating fin. In the embodiment depicted in FIG. 2B the thermally conducting substantially optically transmissive solid material (102) is an intervening layer between the base sheet (101) and the cathodoluminescent material (103) and as such is disposed proximally with respect to the source of thermal energy which is generated in the cathodoluminescent material (103).

The faceplate may be a portion of an envelope of a cathode ray tube which portion exhibits a substantially optically transmissive characteristic and further exhibiting substantially uniform thickness.

The substantially optically transmissive solid material (102) may be deposited by any of many known methods such as, for example, thermally induced precipitative surface crystallization.

Referring now to FIG. 3 a thermal profile of a partial cross-section of a faceplate comprised of fused quartz material is shown. The depiction clearly demonstrates the temperature rise and thermal gradients existing within the faceplate structure as a result of incident thermal flux of 10 Watts per square inch.

The numerals in FIG. 3 depict the temperature ranges represented by each corresponding shaded area.

Referring now to FIG. 4 a thermal profile of a partial cross-section of a faceplate comprised of fused quartz material with a volume of ethyleneglycol convective coolant and radiative fins is shown. The depiction clearly demonstrates the temperature rise and thermal gradients existing within the faceplate structure and coolant as a result of incident thermal flux of 10 Watts per square inch. The numerals in FIG. 4 depict the temperature ranges represented by each corresponding shaded area.

Referring now to FIG. 5 a thermal profile of a partial cross-section of a faceplate comprised of fused quartz material with a layer of substantially optically transmissive diamond film is shown. The depiction clearly demonstrates the temperature rise and thermal gradients existing within the faceplate structure and diamond film as a result of incident thermal flux of 10 Watts per square inch. The numerals in FIG. 5 depict the temperature ranges represented by each corresponding shaded area.

What is claimed is:

1. An optically transmissive display faceplate comprising:

a substantially planar optically transmissive base sheet having at least first and second major surfaces, the base sheet also having a thermal conductivity;.

at least one layer of diamond film disposed on at least a part of the first surface of the at least first and second major surfaces of the base sheet, wherein the at least one layer of diamond film exhibits a thermal conductivity greater than the thermal conductivity of the base sheet; and, a layer of cathodoluminescent material disposed on at least a part of the second major surface of the at least first and second major surfaces of the base sheet.

2. An optically transmissive display faceplate comprising:

a substantially planar optically transmissive base sheet having at least one major surface, the base sheet also having a thermal conductivity;

at least one layer of diamond film disposed substantially planarly on at least a part of the at least one major surface of the base sheet, wherein the at least one layer of diamond film exhibits a thermal conductivity greater than the thermal conductivity of the base sheet; and a layer of cathodoluminescent material disposed on at least a part of the at least one layer of diamond film.

* * * * *